United States Patent [19]

Erdman

[11] 4,376,056

[45] Mar. 8, 1983

[54] FUEL ECONOMY IN INTERNAL COMBUSTION ENGINES

[75] Inventor: Timothy R. Erdman, San Rafael, Calif.

[73] Assignee: Chevron Research Company, San Francisco, Calif.

[21] Appl. No.: 365,662

[22] Filed: Apr. 5, 1982

Related U.S. Application Data

[63] Continuation of Ser. No. 162,700, Jun. 24, 1980, Pat. No. 4,336,149, which is a continuation of Ser. No. 968,527, Dec. 11, 1978, abandoned.

[51] Int. Cl.[3] ..... C10M 3/18; C10M 7/20

[52] U.S. Cl. ..... 252/56 R

[58] Field of Search ..... 252/56 R

[56] References Cited

U.S. PATENT DOCUMENTS

| | | | |
|---|---|---|---|
| 2,482,517 | 9/1949 | Schiermeier et al. | 252/33.4 |
| 2,515,115 | 7/1950 | Davis et al. | 252/56 R |
| 2,564,423 | 8/1951 | Barnum | 252/56 R |
| 2,688,001 | 8/1954 | Echols | 252/49.9 |
| 2,911,367 | 11/1959 | Baus et al. | 252/32.7 E |
| 3,801,540 | 4/1974 | Dexter et al. | 252/56 R |
| 3,933,659 | 1/1976 | Lyle et al. | 252/32.7 E |
| 3,970,570 | 7/1976 | Pratt et al. | 252/56 R |
| 4,167,486 | 9/1979 | Rowe | 252/56 R |
| 4,336,149 | 6/1982 | Erdman | 252/56 R |

*Primary Examiner*—Delbert E. Gantz
*Assistant Examiner*—Helane E. Maull
*Attorney, Agent, or Firm*—D. A. Newell; V. J. Cavalieri

[57] ABSTRACT

The fuel economy of an internal combustion engine can be improved by adding to the lubricating oil used to lubricate the crankcase of said engine from 0.25 to 2 weight percent of pentaerythritol mono-oleate.

2 Claims, No Drawings

FUEL ECONOMY IN INTERNAL COMBUSTION ENGINES

This is a continuation of application Ser. No. 162,700, filed June 24, 1980, now U.S. Pat. No. 4,336,149, which is a continuation of application Ser. No. 968,527, filed Dec. 11, 1978, now abandoned.

FIELD OF THE INVENTION

This invention relates to a method for improving the fuel economy of an internal combustion engine.

BACKGROUND OF THE INVENTION

With the crisis associated with diminishing amounts of fossil fuel and the rapidly increasing prices for this fuel, there has been a great deal of interest in improving fuel economy, that is, the number of miles obtained in a given vehicle per liter of fuel.

Pentaerythritol mono-oleate is an additive which has been widely used, especially in the industrial oil area, and at low concentrations, that is less than about one-half of one percent, in the industrial oils. It is known to be an oiliness agent; however, since piston and ring lubrication is predominantly hydrodynamic, gains in fuel economy through the use of additives in the lubricating oil which reduce the coefficient of friction in mixed lubrication will probably be small and difficult to assess.

SUMMARY OF THE INVENTION

It has now been found that if 0.25 to 2 weight of pentaerythritol mono-oleate is added to the lubricating oil used to lubricate the crankcase of an internal combustion engine a measurable improvement in the fuel economy, that is, the miles per liter of fuel, of the engine is observed.

DETAILED DESCRIPTION OF THE INVENTION

Adding from 0.25 to 2 weight percent, and preferably from 0.40 to 1.25 weight percent of pentaerythritol mono-oleate to a crankcase lubricating oil significantly improves the fuel economy of the internal combustion engine. Specifically, improvements in fuel milage of from 2 to 3% on the average have been observed in engine tests. In certain tests, improvements in milage of 7–8% and more have been observed. This fuel economy improvement has been observed for both compression-ignition engines, that is, diesel engines, and spark-ignition engines, that is, gasoline engines.

Pentaerythritol mono-oleate as it is commercially available is usually a mixture of mono-, di-, tri-, and tetraoleates of pentaerythritol. Some oleic acid may also be present. As used herein, the term "pentaerythritol mono-oleate" is intended to include both pure pentaerythritol mono-oleate and mixtures of pentaerythritol mono-, di-, tri- and tetraoleate.

The lubricating oil to which the pentaerythritol mono-oleate can be added can be any hydrocarbon-based lubricating oil. The hydrocarbon lubricating oils may be derived from synthetic or natural sources and may paraffinic, naphthenic or asphaltic base, or mixtures thereof. A variety of additives are ordinarily present in lubricating oils used to lubricate modern internal combustion engines. These additives include antioxidants, dispersants, rust inhibitors, foam inhibitors, corrosion inhibitors, antiwear agents, and a variety of other well-known additives.

What is claimed is:

1. A lubricating oil composition consisting essentially of an oil of lubricating viscosity and from 0.25 to 2 weight percent of pentaerythritol mono-oleate.

2. A lubricating oil of claim 1 containing 0.40 to 1.25 weight percent of pentaerythritol mono-oleate.

* * * * *

UNITED STATES PATENT AND TRADEMARK OFFICE

CERTIFICATE OF CORRECTION

PATENT NO. : 4,376,056

DATED : March 8, 1983

INVENTOR(S) : Timothy R. Erdman

It is certified that error appears in the above-identified patent and that said Letters Patent is hereby corrected as shown below:

The portion of the term of this patent subsequent to June 22, 1999, has been disclaimed.

Signed and Sealed this

*Thirty-first* Day of *May 1983*

[SEAL]

*Attest:*

DONALD J. QUIGG

*Attesting Officer*

*Acting Commissioner of Patents and Trademarks*